United States Patent [19]

Kitai et al.

[11] 4,045,627

[45] Aug. 30, 1977

[54] SWITCHING MECHANISM FOR ALARMING TIME DETECTION IN AN ALARMING DEVICE

[75] Inventors: Kiyoshi Kitai, Tokyo; Masuo Ogihara, Chiba; Kouzo Sato, Chiba; Nobuo Shinozaki, Chiba, all of Japan

[73] Assignee: Seiko Koki Kabushiki Kaisha, Japan

[21] Appl. No.: 565,116

[22] Filed: Apr. 4, 1975

[30] Foreign Application Priority Data

Apr. 4, 1974 Japan ..... 49-38352

[51] Int. Cl.[2] ..... H01H 43/10; G04B 23/10; G04C 21/36

[52] U.S. Cl. ..... 200/37 R; 58/19 A; 58/38 R

[58] Field of Search ..... 200/35 R, 36, 37 R, 200/37 A, 14, 11 TW, 11 DA; 58/19 R, 38 R, 38 A, 125 C, 125 B, 125 R; 235/1 C

[56] References Cited

U.S. PATENT DOCUMENTS

| | | | |
|---|---|---|---|
| 2,611,232 | 9/1952 | Wuischpard | 200/36 X |
| 2,799,740 | 7/1957 | Blackman | 200/14 |
| 3,339,034 | 8/1967 | Deladerriere | 200/38 R |
| 3,409,748 | 11/1968 | Kawata | 200/36 |
| 3,558,834 | 1/1971 | Zielke | 200/11 TW |
| 3,685,280 | 8/1972 | Fehrenbacher | 58/125 C X |
| 3,819,886 | 6/1974 | Homan et al. | 200/37 A X |
| 3,996,734 | 12/1976 | Kitai et al. | 58/38 R |

*Primary Examiner*—James R. Scott

*Attorney, Agent, or Firm*—Robert E. Burns; Emmanuel J. Lobato; Bruce L. Adams

[57] ABSTRACT

An electrical switch device for detecting preset alarm times in an alarming device comprises a one-piece switch part connected to and rotatable with a rotationally driven time wheel, and first and second fixed switch parts electrically insulated from each other. An alarming circuit is electrically connected to the fixed switch parts and sounds an audible alarm when the switch parts are closed. An alarm time setting mechanism is settable in a predetermined angular position corresponding to the alarm time to be detected so that when the time wheel is driven to the predetermined position, the switch parts are closed thereby activating the alarm.

3 Claims, 8 Drawing Figures

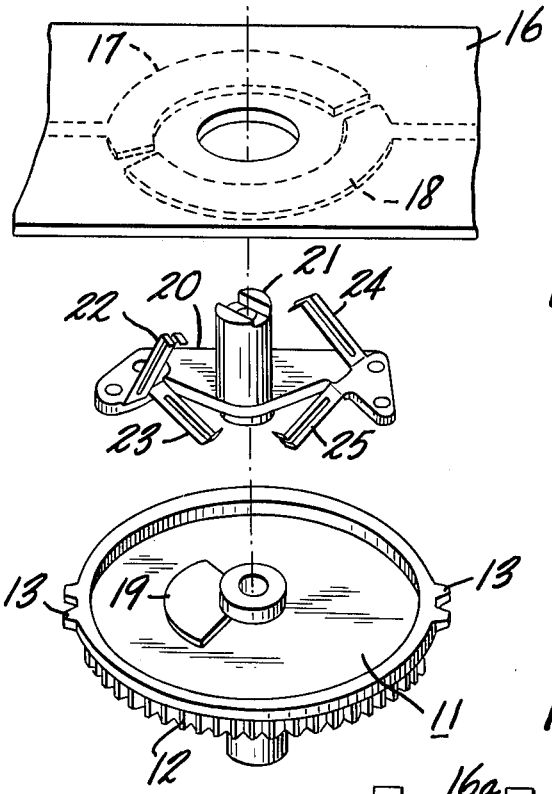
FIG. 4
FIG. 6
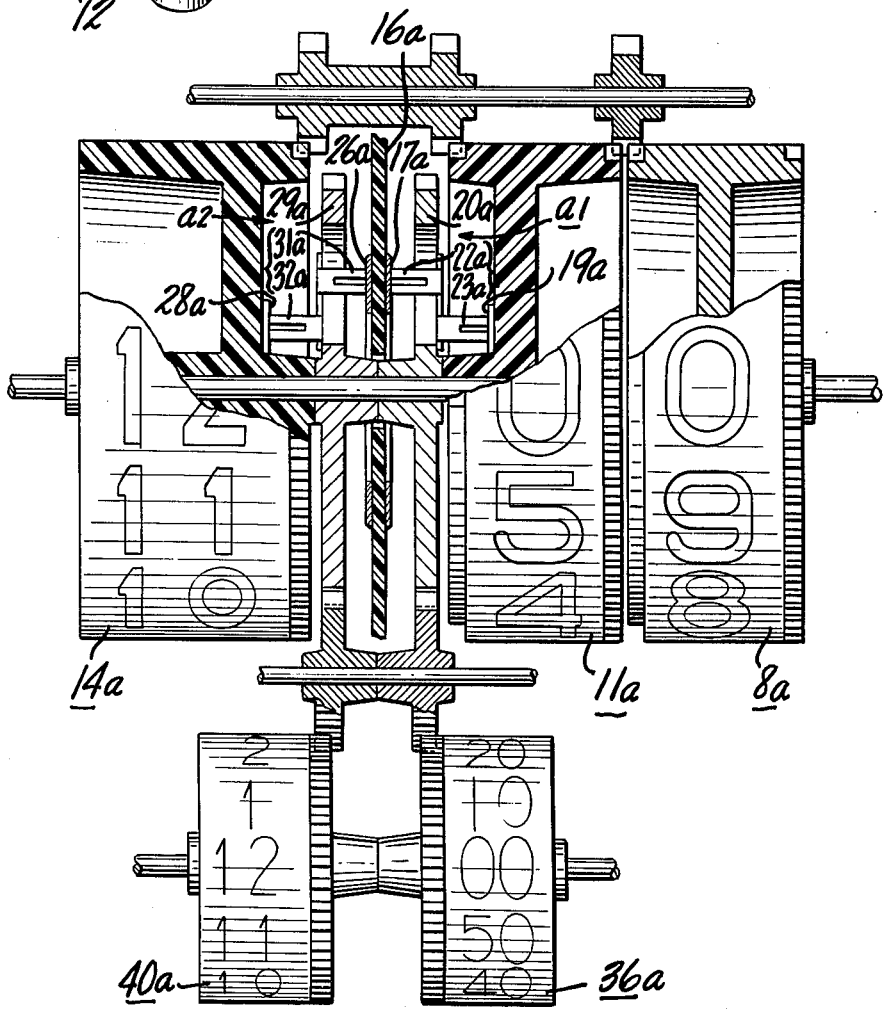

SWITCHING MECHANISM FOR ALARMING TIME DETECTION IN AN ALARMING DEVICE

BACKGROUND OF THE INVENTION

The present invention relates to a switching mechanism for alarming time detection in an alarming device for use in a clock, a timer, and any other device for telling the time, and being operable to detect a preset alarm time and to transmit a signal to operation effect of a time-telling mechanism or other similar electrical mechanism when the set alarm time is reached.

Generally known thus far is a type of switching mechanism for an alarming device of a clock, for one thing, wherein an aperture is formed at a certain position of a rotationally driven drive wheel and a projection is formed on an alarm time setting wheel such that the projection is caused to fall in the aperture when the time wheel and the alarm time setting wheel are rotated into phase with each other whereby the alarm time setting wheel is displaced to the side of the time wheel by virtue of a spring, and the motion of the displacement of the alarm time setting wheel causes a switch to be closed. However, in such a conventional mechanism, the spring action is applied on the time wheel at all times and such is disadvantageous in that the driving energy source (for instance, a motor) of the time wheel has a surplus load unduly applied thereon. In addition, the surface of the projection, in order to fall into the aperture, is so formed as to be vertical for the purpose of improving the precision of alarm time detection, and the alarm time setting wheel cannot but be revolved only in a single direction in the case of turning the alarm time setting wheel for setting anew a different alarm time. These constructional limitations have proven quite inconvenient in the use of the conventional switching mechanism.

The present invention has been devised for the purpose of eliminating the foregoing disadvantages of the conventional switching mechanism, and for providing a new switching mechanism for alarm time detection which is capable of achieving a new effect.

A detailed description of the present invention will be given below, by making reference to the drawings attached hereto to show an illustration of several embodiments of the invention switching mechanism for alarm time detection in the state of being employed in the alarming device of a clock.

BRIEF DESCRIPTION OF THE DRAWINGS

FIG. 4 is an exploded perspective view showing the 10-minute switch in the off position;

FIG. 6 is a side view, partly in section, of another embodiment of alarm time indicating wheels;

DETAILED DESCRIPTION OF PREFERRED EMBODIMENTS

Figure 1:
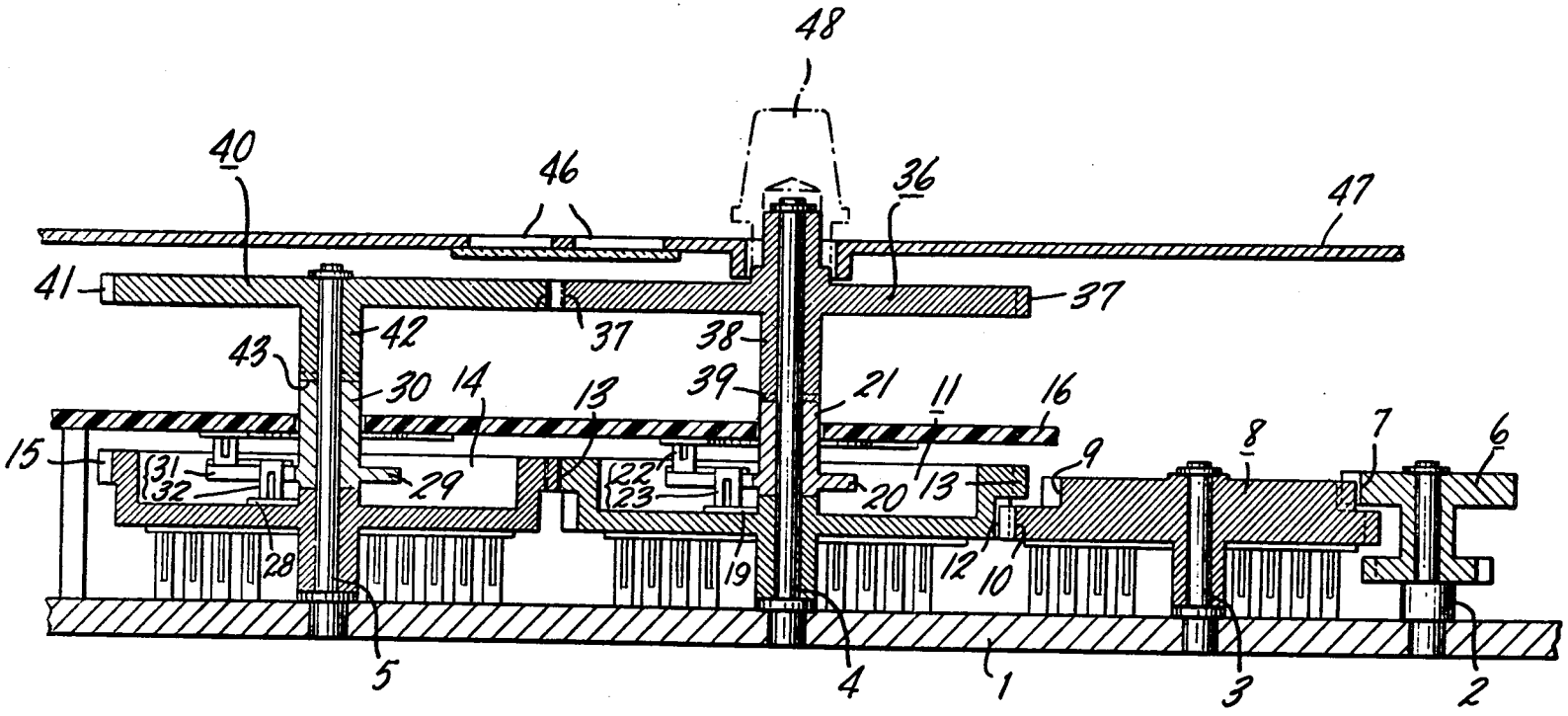
FIG. 1 is a longitudinal section of the alarming device of a clock.
Figure 2:
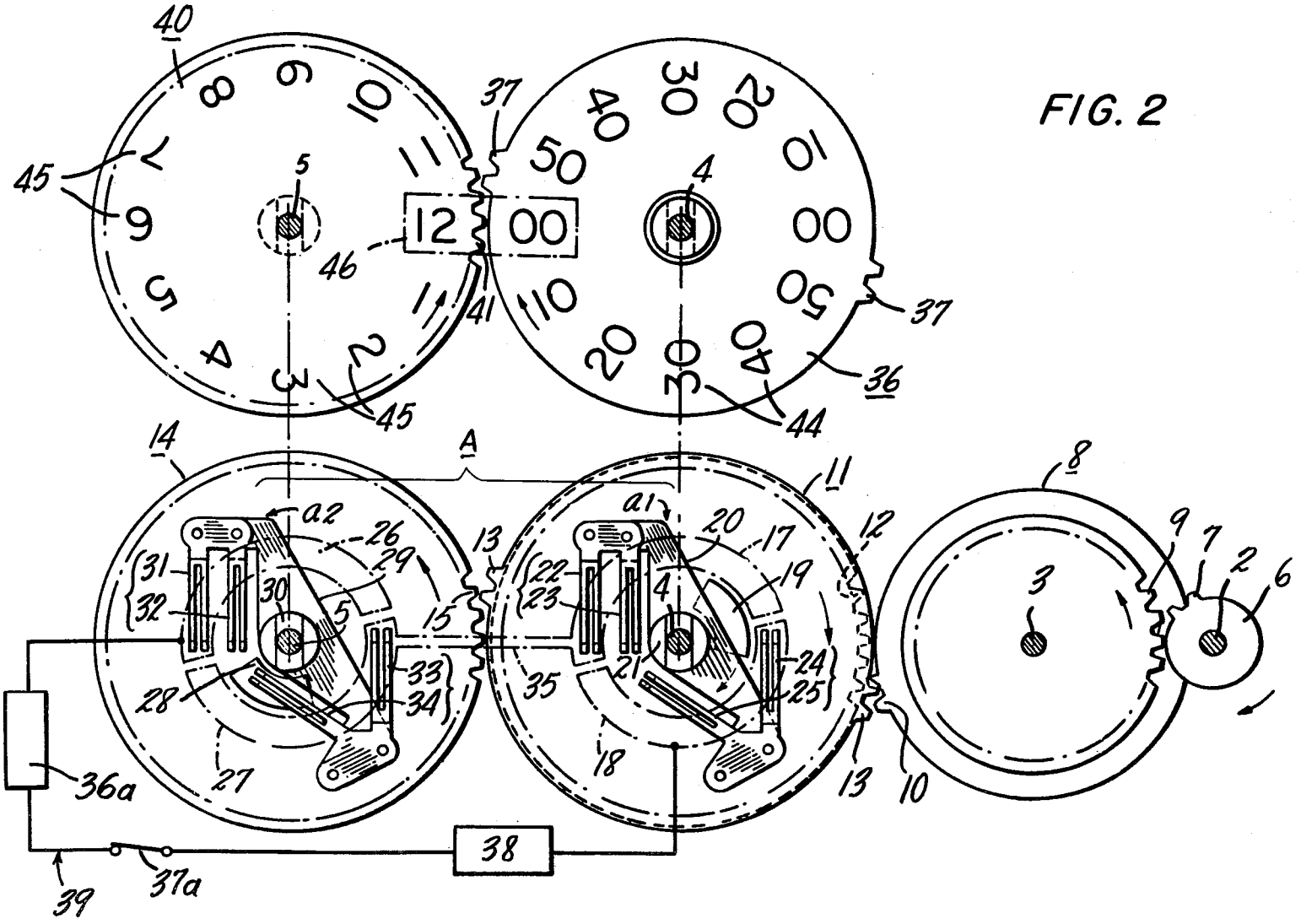
FIG. 2 is an exploded plan view of the alarm time indicating wheel and the switching mechanism.

First of all, a description will be given of the outline of the mechanism of a clock. In FIGS. 1 and 2, the base plate 1 has a series of rotatable shafts 2, 3, 4 and 5 arranged upright in such a manner as to form a linear line. The shaft 2 has a driving wheel 6 provided with a gear 7 for advancing the figure for two gear teeth, the shaft 3 has a minute time wheel 8 provided with a series of continuous teeth 9 engaged with the said gear 7 for advancing the figure and a gear tooth 10 for advancing the figure by two gear teeth, the shaft 4 has a 10-minute time wheel 11 provided with a continuous gear tooth 12 engaged with the gear 10 for advancing the figure and two sets of gear teeth 13, 13 for advancing the figure by two gear teeth, and the shaft 5 has an hour time wheel provided with continuous teeth 15 engaged with the gear teeth 13, 13 for advancing the figure. The time wheels are driven by a drive wheel 6 which is rotationally driven by, for example, a synchronous motor (not shown in the drawing), whereby the time wheels are caused to be revolved through successive specified angles in an intermittent manner.

The switching mechanism for alarm time detection is constituted in such a manner as set forth below. Shown in FIG. 2 is the alarm time 10-minute detection switching mechanism (a) comprised of a 10-minute detection switch ($a_1$) and an alarm time hour detecting switch $a_2$. In FIG. 1, a base plate 16 composed of electrically insulative material is set in place parallel to the base plate 1 in a manner to retain and mount the time wheels 11, 14 in between the base plates. The base plate 16 has a couple of semi-ring-shaped fixed sliding switch pltes 17, 18, including a primary one and secondary one, fixed on the bottom surface of the base plate with a small space being left between the switch plates to electrically separate and insulate them from one another. A fan-shaped revolving slide switch plate 19 of a smaller diameter than the inner diameter of the ring-shaped switch plates is fixed on the upper surface of the time wheel 11 at such a position of a concentric circle as is corresponding to the internal sides of the said ring-shaped switch plates 17, 18. A boss 21 of an alarm time setting detecting member 20 supports the shaft 4 in such a manner that the shaft is free to revolve, and the detecting member is positioned between the base plate 16 and the time wheel 11, and is provided with a primary main contact piece 22 and a primary auxiliary contact pieces 23 having a bifurcated shape and which are fixed in place on one end of the detecting member 20. The main contact piece 22 is caused to be kept in contact with the primary fixed switch plate 17 at all times, and the auxiliary contact piece 23 is kept extended over the track of the revolution of the revolving switch plate 19. In a similar manner, a secondary main contact piece 24 is fixed in place on the other end of the detecting member 20 and is kept in contact at all times with the secondary fixed switch plate 18, and a secondary auxiliary contact piece 25 is kept extended over the track of the revolution of the revolving switch plate 19 at such a position as is near to the auxiliary contact piece 23. In this case, the primary main contact piece 22 and the secondary main contact piece 24 are set in symmetric positions with the shaft 4 as the center thereof.

The alarm time hour detecting switch $a_2$ is the same in construction as that of the switch (a1) as set forth above, and comprises the primary and secondary fixed switch plates 26, 27, a revolving switch plate 28, a detecting member 29 having a boss 30 supported by the shaft 5 in such a manner as to be free to revolve, a pair of primary contact pieces 31, 32, and a pair of the secondary contact pieces 33, 34, and the secondary fixed switch plate 27 is electrically connected in series with the primary fixed switch 17 of the switch $a_1$ through a connecting wire 35.

The switching mechanism (A) comprising the said switches $a_1$, $a_2$ is connected with a time-telling circuit 39 including a power source 36*a,* a main switch 37*a,* and a buzzer 38, in the manner shown in FIG. 2.

An alarm time 10-minute indicating wheel 36 is provided with two pairs 37, 37 of gear teeth for advancing the figure by two gear teeth, and is supported on the shaft 4 in such a manner as to be free to revolve thereon. The wheel (36) has one end of a boss 38 engaged with the boss 21 of the detecting member 20. An alarm time hour indicating wheel (40) is provided with a continuous series of gear teeth 41 engaged with the figure-advancing gear teeth 37 of the indicating wheel 36, and is supported on the shaft 5 in such a manner as to be free to revolve thereon. The wheel (40) has a boss 42 engaged at its base 43 with the boss 30 of the detecting member 29. A set of 10-minute alarm time indicia 44 extend along the peripheral upper section of the indicating wheel 36. A set of alarm time hours indicia 45 extend in the same manner on the indicating wheel, 40 and an opening 46 for viewing the alarm time indication is cut in the cover.

A control knob 48 for alarm time setting is arranged in place on the upper end of the boss 38 of the indicating wheel 36 in such a manner as to protrude over the cover 47.

Now a description of this mechanism will be given below, with regard to the functions and the operation thereof. When the control knob 48 is turned by a specified angle in correspondence to specified alarm time, the indicating wheel 36 and the alarm time setting detecting member 20 revolve, and, in case advance of the figure is effectuated at this time by the indicating wheel, the indicting wheel 40 and the detecting member 29 are also caused to revolve. Now, in the state of the components shown in FIG. 2, the primary and secondary contact pieces 23, 25 of the switch $a_1$ are separated from each other at the specified phase angle with respect to the revolving switch member 19, whereby the switch $a_1$ is caused to be opened, and the primary auxiliary contact piece 32 of the other switch $a_2$ is separated from the revolving switch plate 28 at the specified phase angle, the secondary auxiliary contact piece 34 comes in contact with the revolving switch plate 28, and, thereby the switch $a_2$ is caused to be opened. The alarm time thus indicated is the 12th hour.

Figure 3:
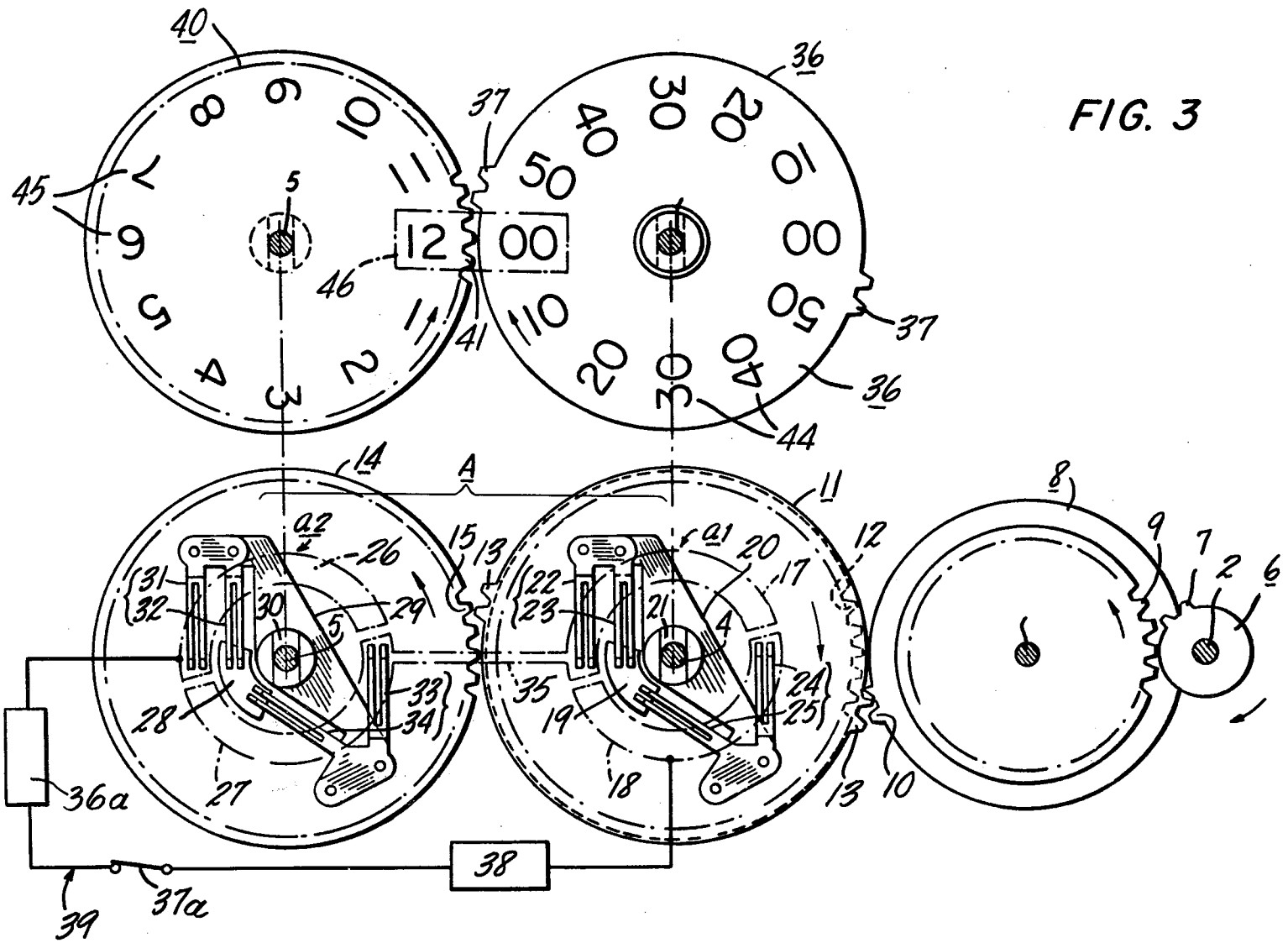
FIG. 3 is an exploded plan view similar to FIG. 2 and showing the switching mechanism in the closed state.

As the time wheels 11, 14 revolve, and when the revolving switch plate 19 and the detecting member 20 conform in phase with each other, and the auxiliary contact pieces 23, 25 come in contact with the revolving switch plate 19, the switch plate 28 and the detecting member 29 are conformed in with each other, and the auxiliary contact pieces 32, 34 come in contact with the revolving switch 28, the other switch $a_2$ is also closed. At the moment both of these switches $a_1$, $a_2$ are closed, the buzzer 38 arranged on the time telling circuit 39 is caused to be put in operation, as shown in FIG. 3. During the time the auxiliary contact pieces 23, 25 are kept in contact with the switch plate 19, telling of the time is conducted in a continuous manner.

In order to set the alarm time once again, it is necessary to turn the knob 48 through an appropriate angle, while viewing the time as indicted through the indication opening 46, thus causing the indicating plate and the detecting member to be displaced the desired amount. In this case, once the respective contact pieces come in contact with the switch plate in such a manner as to be free to revolve, the operation of setting the alarm time by means of the knob 48 can be conducted in any direction, either advanced or retarded.

Figure 5:
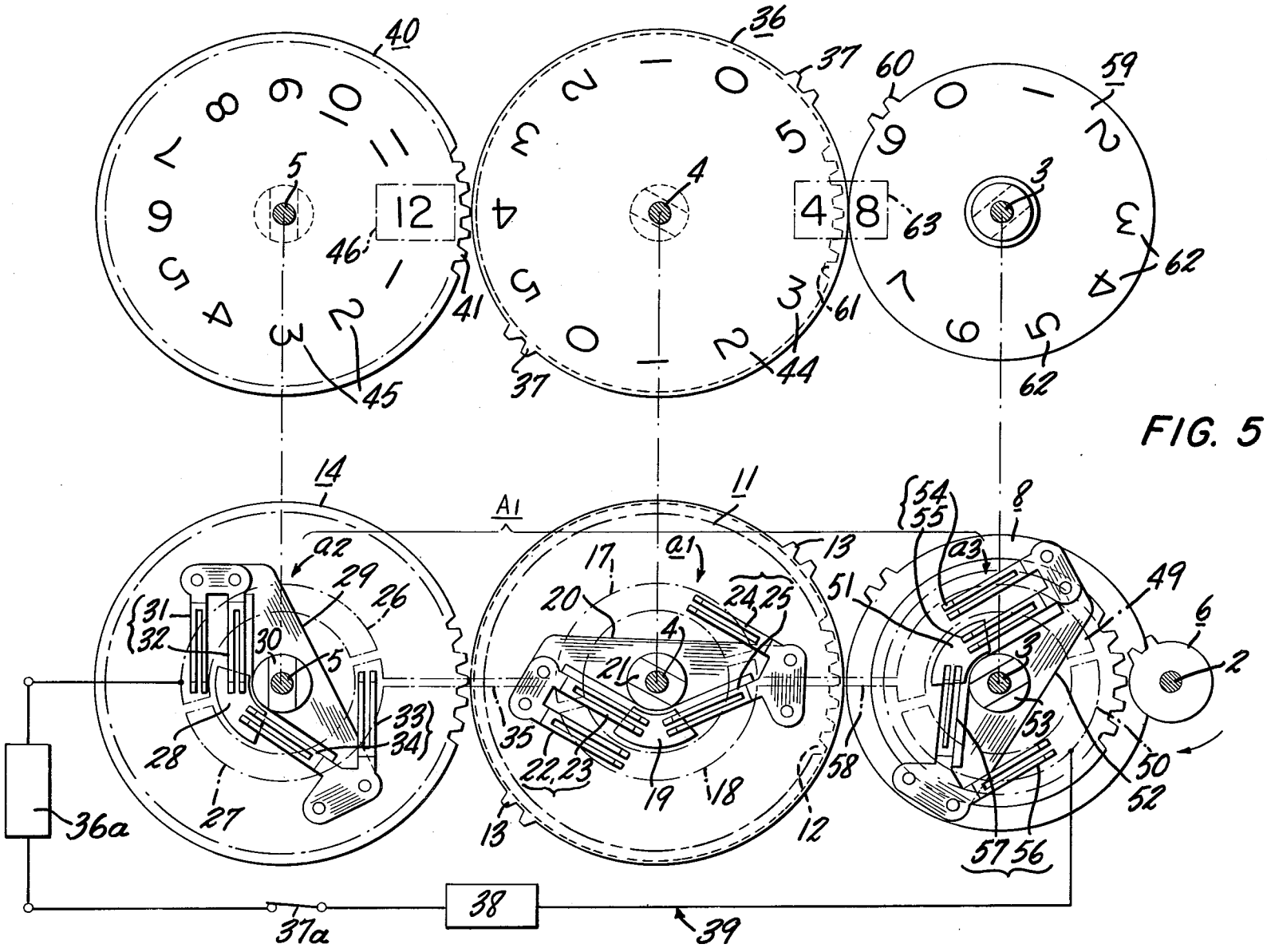
FIG. 5 is an exploded plan view of another embodiment of the alarm time indicating wheel and the switching mechanism.

In the case of the embodiment shown in FIG. 5, an alarm time minute detecting switch mechanism A1 includes a minute detecting switch $a_3$ comprises of the primary and secondary fixed switch plates 49, 50, a revolving switch plate 51, an alarm time setting detecting member 52 provided with a boss 53, primary main and auxiliary contact pieces 54, 55 and secondary main and auxiliary contact pieces 56, 57, all mounted on the minute time wheel 8 and the electrically insulative base plate (16). Basically, the minute detecting switch $a_3$ is added to the switching mechanism A shown in FIG. 2. In this case, the primary fixed switch plate 49 of the switch $a_3$ is connected in series with the secondary fixed switch plate 18 of the switch $a_1$ by a connecting wire 58.

An alarm time minute indicating wheel 59 provided with a shift tooth 60 is supported on the shaft 3 so as to be free to revolve thereon and is engaged with the time wheel 8, a 10-minute indicating wheel 36 has continuous teeth 61 which are engaged with the shift tooth 60. In this case, the knob 48 is set in place on the alarm time minute indicating wheel 59. A set of minute time indication 62 are provided on the wheel (59) for viewing through a minute time indicating opening.

Shown in FIG. 6 is an embodiment of switching mechanism according to the invention for the alarming time detection of the so-called drum type clock, wherein a base plate 16*a* composed of electrically insulative material is set in place between an alarm time 10-minute indicating wheel 11*a* and an alarm time hour indicating wheel 14*a.* A set of primary main and auxiliary contact pieces 22*a,* 23*a* and secondary main and auxiliary contact pieces (not shown in the drawing) are set in place on a gear type alarm time setting detecting member. 20*a* which is positioned between the base plate 16*a* and the alarm time 10-minute indicating wheel 11*a.* These contact pieces are caused to come in contact with the primary switch plate 17*a* and the secondary switch plate (not shown in the drawing), each fixed in place on the base plate 16*a,* and on such a revolving switch plate 19*a* which is fixed in place on the base plate 16*a,* respectively, to thus constitute the alarm time 10-minute indicating switch $a_1$. The alarm time hour indicating switch $a_2$ is likewise constituted of a gear type detecting member 29*a,* the primary main and auxiliary contact pieces 31*a,* 32*a,* secondary main and auxiliary contact pieces (not shown), a primary switch plate 26*a,* secondary switch plate, and a revolving switch plate 28*a.* In the drawing, 8*a* is a minute time wheel, 36*a* is a 10-minute time indicating wheel, and 40*a* is an alarm time hour indicating wheel.

Figure 7:
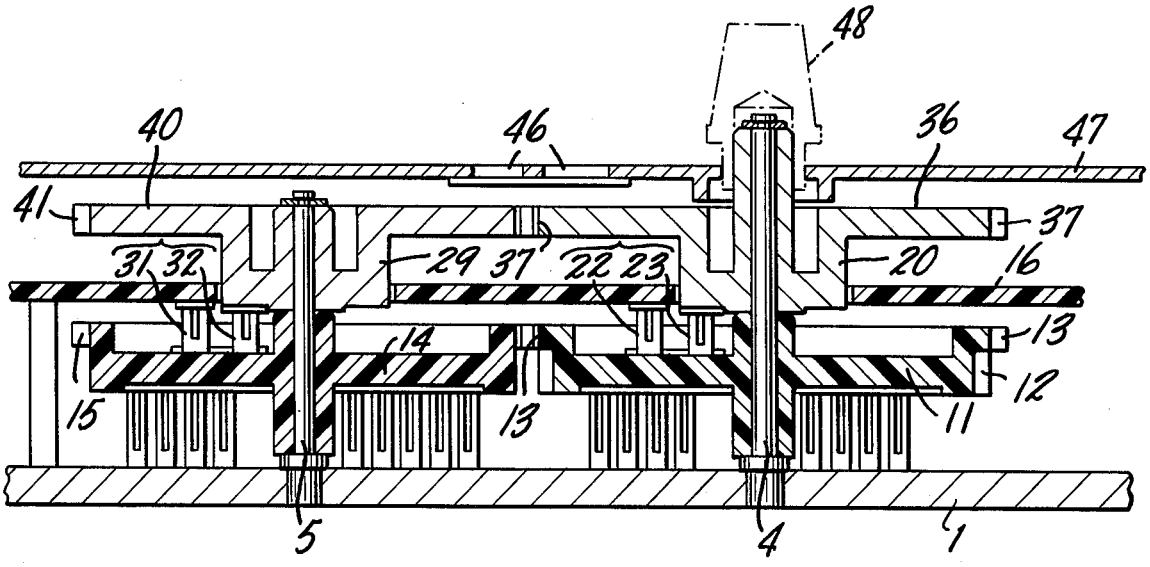
FIG. 7 is a longitudinal section of another embodiment.
Figure 8:
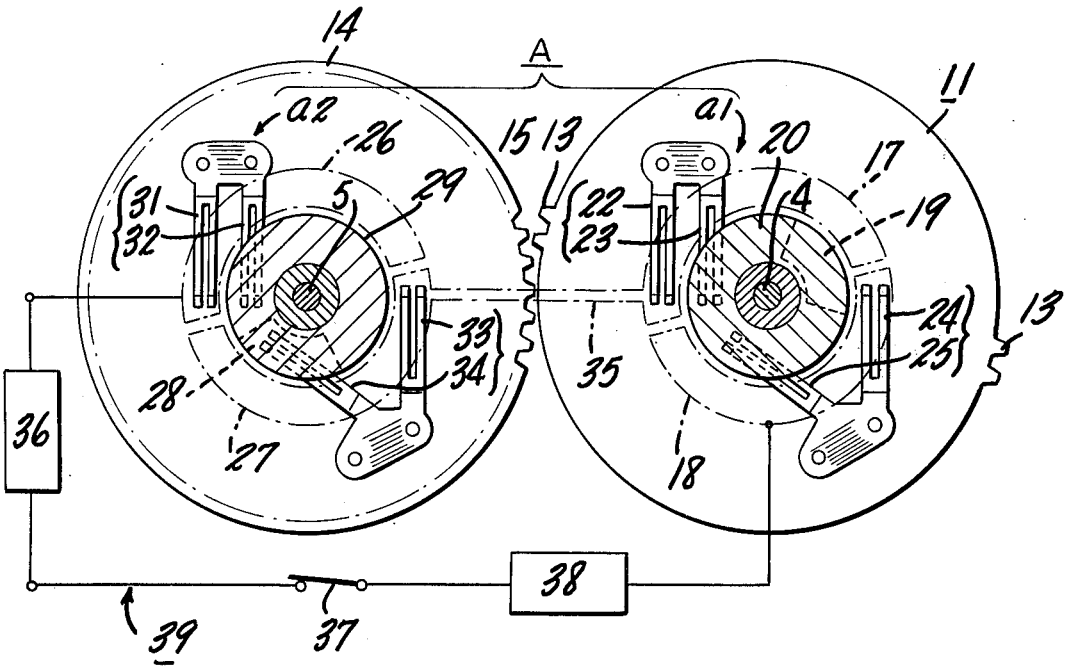
FIG. 8 is an exploded plan view of a part of what is shown in FIG. 7.

Next, a description will be given below with regard to still another embodiment shown in FIG. 7 and FIG. 8. In this embodiment, an alarm time 10-minute indicating wheel 36 and an alarm time 10-minute setting detecting member 20 are so constituted as to be an integral entity, and, an alarm time hour setting detecting member 29 and an alarm time hour indicating wheel 40 are so constituted as to be an integral entity. Furthermore, the detecting switches $a_1$, $a_2$ for each alarm time unit have fan-shaped revolving slide switch plates 19, 28 fixed in place on the alarm time 10-minute setting detecting member 20 and the alarm time hour setting detecting member 29, respectively. A set of primary main and auxiliary contact pieces 22, 23 and secondary main and auxiliary contact pieces 24, 25 are fixed in place on the 10-minute time wheel 11 which is composed of electrically insulative material, and a set of primary contact pieces 31, 32 and secondary contact pieces 33, 34 are fixed in place on the hour time wheel 14 which is likewise composed of electrically insulative material respectively, thus being constituted into an integral entity.

With regard to other modes of construction and functions, such are virtually the same as those in the case of the illustrations shown in FIG. 1 through FIG. 4, and hence omitted herein.

When the switching mechanism for detecting the alarm time in the alarming device according to the first embodiment of the present invention is employed, the spring action is kept free from functioning on the time wheel until the source of the driving force has a surplus load unduly applied thereon, unlike the case with the conventional switching mechanism, whereby a time-telling device can be properly maintained in a correct and accurate operation. During the alarm time setting control, each and every contact piece comes in contact with the slide switch plate in such a manner as to be free to slide thereon so that the alarm time setting is controllable by simply turning an alarm time setting device either in the forward direction or in the reverse direction, thus rendering the use thereof quite convenient. More, the alarm time setting detecting devices only have to be revolved at the time of alarm time setting control; therefore, the alarm time is indicated in a quite legible state simply by viewing the alarm time indication on the detecting devices; furthermore, in case the alarm time setting detecting devices are employed for the alarming device of the so-called drum-type clock, it is not necessary to move the shafts and the like that support the drum, and this is advantageous in that the drum-supporting mechanism can be greatly simplified.

In the case of the alarm time detecting switching mechanism according to the second embodiment of the invention unlike the conventional method which, in the case of setting a fixed slide switch plate in place on a base plate or the like, generally has a couple of ring-shaped slide switch plates of different diameters arranged in place in a duplicated manner, the present invention adopts a construction wherein a couple of semi-ring-shaped slide switch plates are arranged in place on one and the same plane in the shape of a ring; therefore, this switching mechanism for detecting alarm time involves such multifarious advantages that the space of the plane required for setting the same can be reduced, that both of the slide switch plates can be formed as printed circuit boards, that, in the case of applying metal plating thereon, an electrode can readily be set in place thereon and that the area of the slide switch plate can be reduced, thus proving quite beneficial in terms of cost in the case of applying gold-plating thereon.

What is claimed is:

1. An electrical switch device for detecting alarm times in an alarming device comprising: a one-piece switch part; first and second fixed switch parts each having a generally semi-ring shape and being disposed opposite and slightly spaced from one another to define a generally ring shape and being electrically insulated from each other by the slight spacing therebetween; an alarming circuit electrically connected to said first and second switch parts; first and second contact members each of which has a first contact part and a second contact part; a rotationally driven time wheel; a manually rotatable member settable to a desired angular position corresponding to the desired alarm time to be set; and alarm time detecting means engageable with said time wheel in accordance with the movement of said manually rotatable member and operable to detect the set alarm time; said one-piece switch part being fixed on one of said time wheel and alarm time detecting means and said first and second contact members being fixed on the other of said time wheel and alarm time detecting means; said first contact parts being disposed in superposed relation to and in engagement with said respective first and second fixed switch parts and said second contact parts being engageable with said one-piece switch part so that when said alarm time detecting means detects said set alarm time, said second contact parts are electrically connected with said one-piece switch part thereby electrically connecting said first and second fixed switch parts in series with said first and second contact members.

2. An electrical switch device according to claim 1; wherein said one-piece switch part has a partly annular shape, and said first and second fixed switch parts and one-piece switch part are all disposed about a common center axis.

3. An electrical switch device according to claim 1; wherein said first and second fixed switch parts are formed from a printed circuit panel.

* * * * *